United States Patent [19]

Gardella et al.

[11] Patent Number: 4,919,979

[45] Date of Patent: Apr. 24, 1990

[54] COMPACTED BALE

[75] Inventors: Peter Gardella, San Francisco, Calif.; Kevin L. Wood, West Linn, Oreg.

[73] Assignee: Norcal Solid Waste Systems, Inc., San Francisco, Calif.

[21] Appl. No.: 85,364

[22] Filed: Aug. 14, 1987

Related U.S. Application Data

[62] Division of Ser. No. 848,031, Apr. 3, 1986, Pat. No. 4,729,304.

[51] Int. Cl.[5] ..... B30B 15/06; B30B 15/32

[52] U.S. Cl. ..... 428/2; 206/83.5

[58] Field of Search ..... 206/83.5; 428/2, 35

[56] References Cited

U.S. PATENT DOCUMENTS

| | | | |
|---|---|---|---|
| 212,925 | 3/1879 | Groom | 206/83.5 |
| 3,059,789 | 10/1962 | Bowles | 414/304 |
| 3,330,088 | 7/1967 | Dunlea, Jr. | 428/2 X |
| 3,753,506 | 8/1973 | Palmer et al. | 414/332 |
| 3,971,451 | 7/1976 | Norberg | 414/21 X |
| 4,102,262 | 7/1978 | Liberman et al. | 414/21 X |
| 4,256,434 | 3/1981 | Stodt et al. | 414/786 |
| 4,352,624 | 10/1982 | Matsumoto | 414/400 |
| 4,487,120 | 12/1984 | Barstow | 414/786 X |
| 4,729,304 | 3/1988 | Gardella et al. | 100/218 |

*Primary Examiner*—Henry F. Epstein

*Attorney, Agent, or Firm*—Julian Caplan

[57] ABSTRACT

A bale of compressed garbage and other refuse is formed in a stationary baling chamber by compressing successive charges of refuse against an inclined discharge gate by means of a multi-stage hydraulic ram having a platen or specific shape. The bale thus has a rectangular transverse cross-section having parallel sides and parallel top and bottom, a forward end upwardly-rearwardly inclined at about 15° from the vertical and a rearward end having a vertical lower stretch extending upward from the bottom about half the height of the bale, an upwardly-forwardly inclined stretch at about 42° to the horizontal above the lower stretch and a short vertical stretch above the inclined stretch.

3 Claims, 3 Drawing Sheets

COMPACTED BALE

This is a division, of application Ser. No. 840,831 filed 4/3/86 now U.S. Pat. No. 4,729,304.

BACKGROUND OF THE INVENTION

1. Field of the Invention

This invention relates to a new and improved compactor and transfer chamber for refuse. More particularly, the invention relates to means for compacting large quantities of garbage and other refuse in a baling chamber and then, upon lifting of an end gate, the load is pushed onto the bed of a truck for further transportation.

2. Description of Related Art

Heretofore, the common commercial means for preparing refuse for long distance transportation has differed from the structure of the present invention in that compaction of the load has been performed when the load is in the bed of the truck or trailer. This system is very destructive of trailers. The present invention differs from past commercial systems in that the baling is conducted in a stationary chamber and then the load is pushed onto the bed of a truck. Therefore, the trailer walls bear little or no load; indeed, a flatbed truck may be used. Accordingly, the trailer may be constructed in a less rigid manner and the weight of the trailer thereby reduced making the trailer capable of transporting a greater payload.

Pat. Nos. 3,753,506 and 4,256,434 illustrate generally the prior system where compaction occurs within the truck.

No reference known to applicant shows a platen for compaction of a bale wherein the lower portion of the platen is substantially vertical, the upper half slants forwardly and there is a short vertical top surface. Furthermore, there is no reference known applicant wherein the rear of the bale is complementary to such platen shape, nor where the forward face of the bale is slanted rearwardly at approximately a 15° angle by reason of the fact that the end gate of the baling chamber is slanted rearwardly at approximately such angle.

Non-square and tilted bales are shown in such patents as 3,059,789; 3,753,506; 4,352,624; and 4,487,120. However, such shapes are caused primarily by ejectors in the receiving vehicle itself rather than the loading apparatus.

The angle of the gate is not shown in the art. However, in Pat. No. 4,102,262 there is a clearing device which is slanted but the load is compacted directly into the receiving vehicle.

Weighing the apparatus and its load to sense the amount of the load is shown in such patents as 3,971,451 and 4,102,263.

SUMMARY OF THE INVENTION

A stationary baling chamber is located below an extensive apron on which garbage and other refuse dumped from collection vehicles is moved by bulldozers or other scrapers toward an opening in the apron, which opening is aligned with an opening in the top of the baling chamber which lies below the apron. Beyond the discharge end of the chamber is a truck loading dock and the completed bale is discharged directly into the bed of the trailer or truck at such dock. The trailer is hitched to the chamber; if there is excessive force transmitted to the trailer, ejection of the bale is discontinued.

At the discharge end of the trailer is a gate which slides in guides at an angle of 15° to the vertical disposed rearwardly. The refuse is compacted against this gate. When the load is completed, the gate is raised permitting the compacted material to be discharged.

Reciprocating within the baling chamber is a platen actuated by a large multi-staged hydraulic ram. The ram is driven by a series of hydraulic pumps in such manner that forward movement of the ram is terminated when the pressure reaches a predetermined amount and the ram retracts. A platen is supported by a carriage which reciprocates within the baling chamber on rollers which bear against the top, bottom and sides of the chamber walls. The platen has a vertical face at the bottom extending about half the height of the baling column and then has a slanted face which slants forwardly, upwardly to a point near the top of the column and a vertical face at the extreme top of the platen. The ram is multi-stage and its outer sections are mounted on tracks. The platen moves from a retracted position behind the opening through which the refuse is charged into the baling chamber to an extreme forward position beyond the front of the baling chamber and within the trailer. The platen thereby pushes the bale out of the chamber onto the bed of a truck hitched to the chamber.

Other objects of the present invention will become apparent upon reading the following specification and referring to the accompanying drawing in which similar characters of reference represent corresponding parts in each of the several views.

DESCRIPTION OF PREFERRED EMBODIMENT

Figure 1:
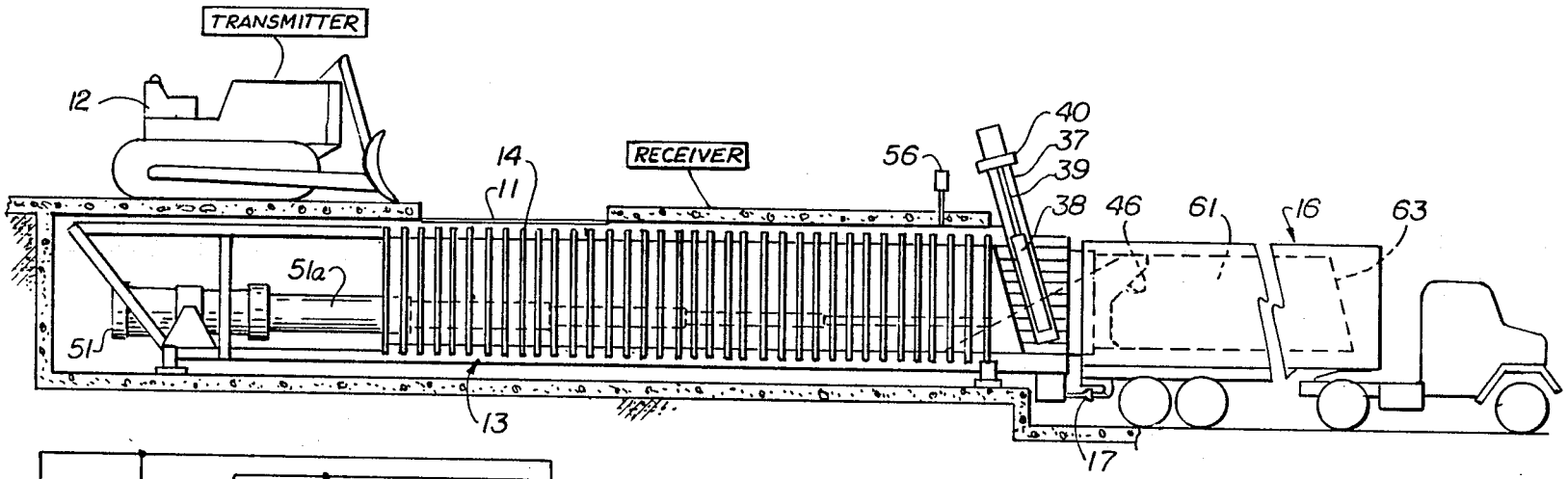
FIG. 1 is a schematic side elevational view of the system of the present invention partly broken away in section to reveal internal construction.
Figure 4:
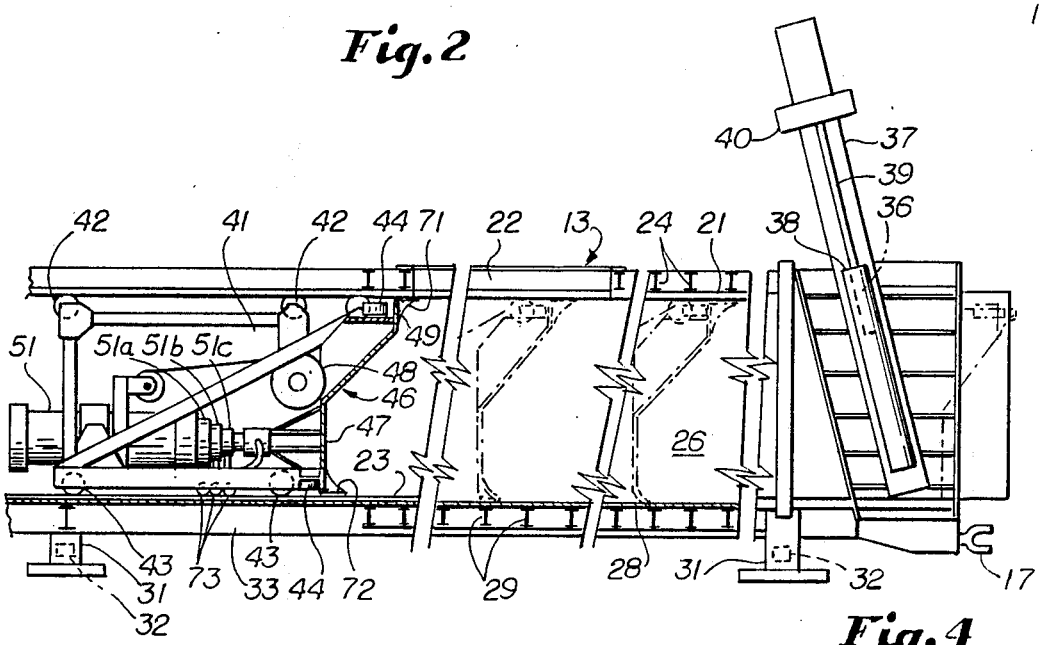
FIG. 4 is an enlarged sectional view of the structure of FIG. 2 partly broken away to conserve space.
Figure 5:
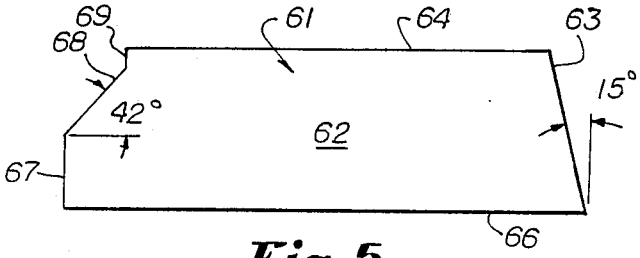
FIG. 5 is a side elevational view of a bale formed in the baling chamber of the present invention.
Figure 6:
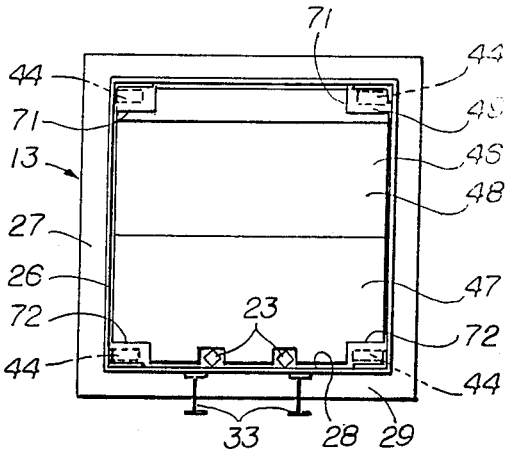
FIG. 6 is a sectional view of the baling chamber taken substantially along line 7—7 of FIG. 1.
Figure 7:
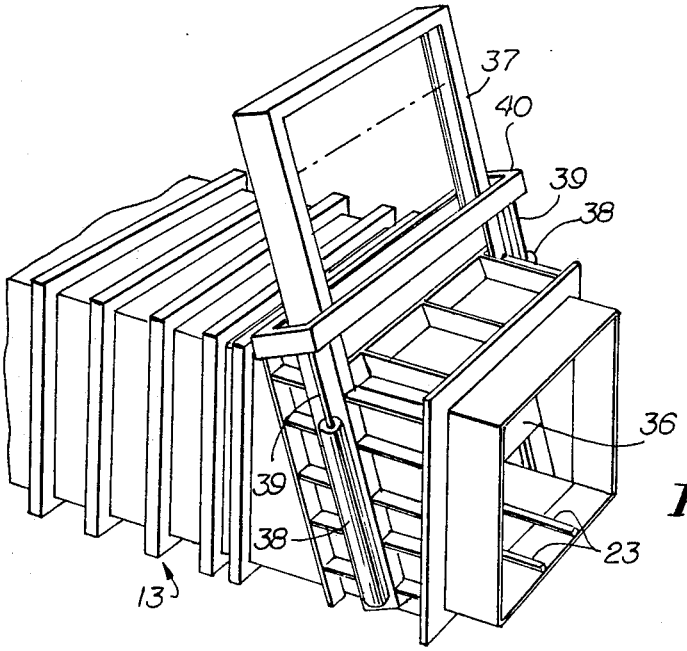
FIG. 7 is a fragmentary perspective view of an end of the baling chamber showing means for raising and lowering the end gate.
Figure 8:
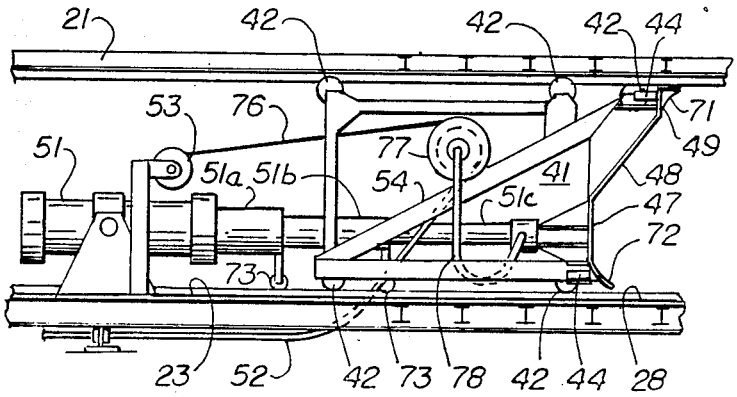
FIG. 8 is a side elevational view of the carriage and ram in retracted position.

As best shown in FIGS. 1 and 4, the present invention employs an extensive concrete apron 11 onto which refuse collection vehicles deposit their loads. Bulldozers or similar scrapers 12 push the refuse over the apron 11 toward the opening 14 which is in register with a corresponding opening in the baling chamber 13 which is immediately below baling chamber 13. At one end of chamber 13 is a truck loading dock at which trucks or trailers 16 may be parked and connected to the chamber 13 by a hitch 17 which hitches onto the tail of the trailer 16 to prevent it from being pushed forward when the load is discharged thereon as hereinafter appears.

Chamber 13 has a top 21 formed of plate into which fits a rectangular frame 22 immediately under the opening 14 in apron 11. A number of crossbeams 24 rigidify the top 21. Vertical sides 26 extend longitudinally of the chamber 13, the sides 26 being formed of plate reinforced by columns 27 which are of I-beam or equivalent construction. Similarly, there is a bottom plate 28 which extends the length of the chamber 13 which bottom is reinforced and supported by transverse I-beam 29 and longitudinal members 33 which are supported by pedestals 31 having incorporated therein weight sensors 32. When the total weight of the chamber 13 and its contents as measured by the sensors 32 equals a predetermined amount, the charge of refuse into the chamber is terminated since this predetermined weight equals the load capacity of the truck or trailer 16.

At the forward or discharge end of chamber 13 is a gate 36 which reciprocates in a gate guide frame 37 slanted rearwardly, at an angle of 15 degrees to the vertical to a position above chamber 13. Gate 36 is attached to a transverse frame 40 fitting around frame 37. Gate rams 38 are mounted on either side of frame 37. Their rods 39 are fixed to frame 40. Hence gate 36 reciprocates within structure 37. As the gate rams 38 are energized the gate 36 is lifted by transverse frame 40 to open the discharge end of chamber 13. When the gate 36 is in lowered position, it constitutes a wall against which the refuse within the chamber is forced.

Reciprocating within the chamber 13 is a carriage 41 having top rollers 42 bearing against the underside of top 21 and bottom rollers 43 bearing against the bottom 28, as well as side rollers 44 at both the top and bottom which bear against the sides 26. On the forward end of carriage 41 is a platen 46. Platen 46 has a lower portion 47 which extends vertically upwardly to about one-half the height of chamber 13 and thereabove is a forward slanted portion 48 disposed at an angle of 42° to the horizontal which extends close to the top 21. Above slanted portion 48 is a short vertical portion 49. At each top corner of the platen are side roller 44 and protectors 71 and at the bottom corners are bottom roller 43 and protectors 72.

Pivotally disposed at the forward end of chamber 13 is a multi-stage hydraulic ram 51 which is attached to the rear of the platen 46. The capacity of ram 51 is sufficient so that is will move the carriage from the retracted position shown in FIG. 4 in solid lines (behind opening 14) to the extreme forward position shown at the right of FIG. 4 in dot and dash lines. Tracks 23 support and guide the rollers 73 which support cylinder stages 51*a, b, c* of ram 51 as they extend and retract. Hose 52 is attached to the forward end of ram 51 to conduct hydraulic fluid for retraction of the ram. A reel motor 53 is connected by cable 76 to reel 79 which winds hose 52. Second hose 78 runs from reel 77 to a port on the far end of ram section 51*c*. The carriage 41 is subject to considerable stress and, accordingly, braces 54 and other means are employed to support the structure.

Figure 9:
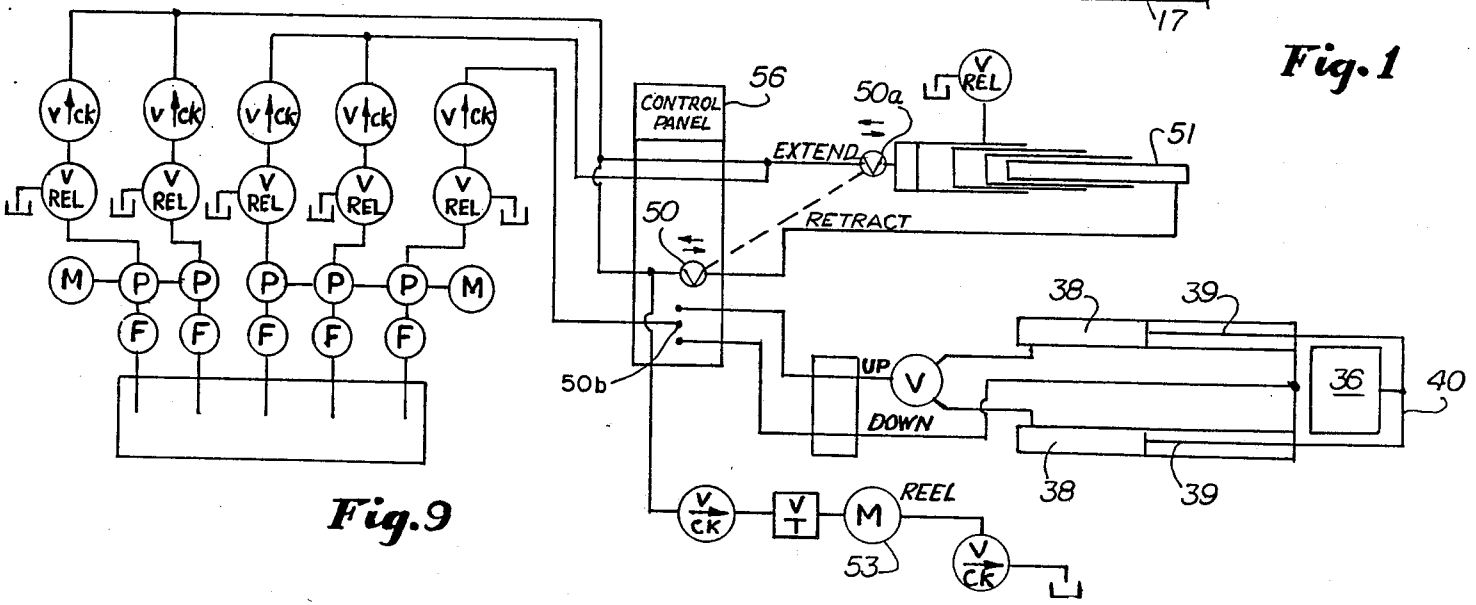
FIG. 9 is a schematic hydraulic diagram of the invention.
Figure 3:
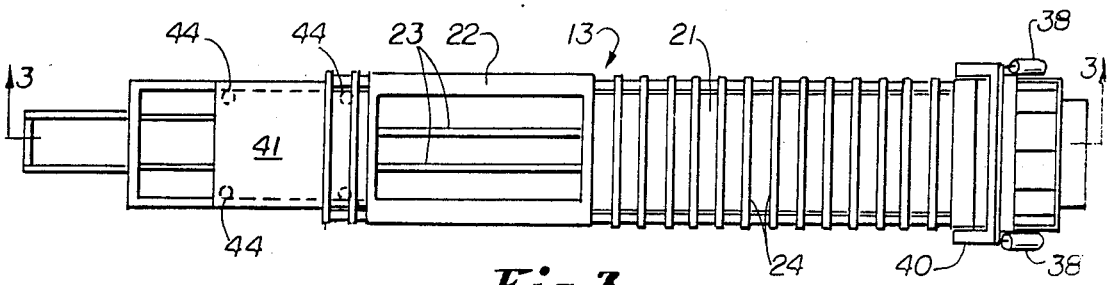
FIG. 3 is a to plan view thereof.
Figure 2:
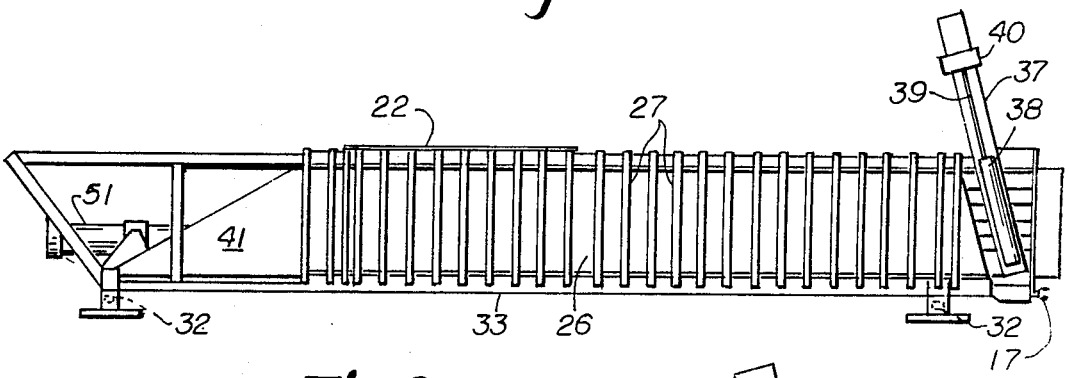
FIG. 2 is a side elevational view of the baling chamber.

In operation, bulldozer 12 which serves as a scraping means drops refuse through the opening 14 into the baling chamber 13, it being understood that the platen 46 is retracted while the dumping occurs. A typical load is approximately 15 cubic yards of material. The carriage 41 is then moved forward, by energizing ram 51, pushing the first load forward. The relief valves shown in FIG. 9 are two-way solenoid-controlled valves, each having an open position discharging to a reservoir for fluid and a closed position whereby fluid under pressure is delivered to valves 50 and 50*a*. With valve 50*a* open and 50 closed, ram 51 is thus energized. Valve 50*b* controlling gate 36 is a two-way valve, manually controlled to open or close the gate. The platen is then retracted and another load of approximately 15 yards is deposited in the chamber. Reversal of valves 50 and 50*a* causes the ram to retract. Thereupon, the ram 51 is again energized, forcing the two loads against the gate 36 until the pressure exerted reaches a predetermined pressure of approximately 2000 psi, whereupon, carriage 41 automatically retracts. The extension of the ram 51 is radio-controlled by the operator in the bulldozer 12. Control panel 56 is subject to wide variation but includes the manually controlled, two-way valve 50*b* shown in FIG. 9. Refuse is repeatedly charged into the opening 14 and, as each charge is deposited, the operator, by radio, causes the ram 51 to extend, building up successive compacted charges in layers within the chamber 13. When the total weight within the chamber 13 reaches a predetermined amount, the operator reads a scale readout panel and control panel 56 from his position on the tractor. The operator then moves to the control panel 56 and energizes valves which cause the gate 36 to be raised. Thereupon the ram 51 is again energized, pushing the platen 46 forwardly to approximately the end of the chamber 13 and this pushes the load onto the bed of truck or trailer 16. When the load has been deposited on the truck, the hitch 17 is disconnected and the bale 41 transported to a suitable dump. Hitch 17 has a sensor (not shown) which, through electrical means, deengages ram 51 if excessive force is applied to the trailer during ejection of the bale (e.g., blockage of movement of the bale). The sensor is a common pressure switch which senses the force tending to separate hitch 17 and if it exceeds a pre-selected amount, energizes the solenoids of the relief valves shown in FIG. 9 to open said valves, as will be well understood by those skilled in the art. This is a safety feature preventing trailer damage.

Bale 61 has vertical longitudinal side faces 62 and horizontal longitudinal top and bottom faces 64 and 66. The front face 63 is slanted rearward at an angle of approximately 15° degrees from the vertical thereby being complementary to the gate 36. The rearward end of bale 61 has a rear lower face 67 which is transverse and vertical and extends up about half the height of the bale 61. Above the lower face 67 is a forwardly-upwardly slanted face 68 disposed at an angle of about 42° to the horizontal and extending almost to the top of the bale. At the top of the rear of the bale is a top face 69 which is vertically disposed. Thus the faces 67, 68, 69 are complementary to the forward face of the platen 46.

FIG. 9 shows schematically the hydraulic system for the compactor. As used therein, "VCK" means "check valve", "VREL" means "relief valve", "VT" means "throttling valve", "M" means "motor", "P" means "pump", and "F" means "filter ".

Directing attention to the schematic diagram of FIG. 9, when scraper 12 has deposited a sufficient load through opening 14 into the chamber the operator causes the transmitter to signal the receiver to cause valves 50 and 50*a* to energize the ram 51. The motors or prime mover M causes pumps P to draw fluid from the Reservoir through filters F and relief valves VREL and check valves VCK to energize the ram.

When the pressure in cylinder 51 reaches a predetermined pressure (e.g., 2000 psi), the relief valve for the cylinder opens and a sensor in hitch 17 causes valves 50 and 50*a* to reverse, causing the ram to retract. Hydraulic reel motor 53 is driven by fluid which is by-passed enroute to ram 51.

The operator actuates switch 50*b* to cause the gate 36 to open or close. When the gate is open, opening of valve 50*a* causes the ram to push the compacted bale 61 out of the baling chamber and into the vehicle 16.

What is claimed is:

1. A bale of compacted material of substantially rectangular transverse cross-section having parallel sides and parallel top and bottom, a forward end inclined upwardly-rearwardly and a rearward end have a vertical lower stretch extending upward from the bottom about half the height of said bale, an upwardly-forwardly inclined stretch above said lower stretch and a short vertical stretch above said inclined stretch.

2. A bale according to claim 1, in which said forward end is inclined at about 15° from the vertical.

3. A bale according to claim 1 in which said inclined stretch is about 42° to the horizontal.

* * * * *